United States Patent [19]

Geldwerth et al.

[11] 4,426,854

[45] Jan. 24, 1984

[54] SLIP-ON CONNECTOR FOR JEWELRY CLASP AND BLANK FOR CLASP

[75] Inventors: Simon Geldwerth, Brooklyn; Mendek Rubin, New York, both of N.Y.

[73] Assignee: Do-All Jewelry Mgf. Co., Inc., Brooklyn, N.Y.

[21] Appl. No.: 379,188

[22] Filed: May 17, 1982

[51] Int. Cl.[3] ..... A44C 5/00; B23K 33/00; A44B 19/00; F16G 15/00

[52] U.S. Cl. ..... 63/4; 24/237; 24/616; 59/93; 228/101

[58] Field of Search ..... 63/4; 24/230 R, 237, 24/240; 228/101, 171, 172, 192; 59/93, 80, 82, 83, 90

[56] References Cited

U.S. PATENT DOCUMENTS

| | | | |
|---|---|---|---|
| 136,648 | 3/1873 | Flatley | 24/230 R |
| 184,211 | 11/1876 | Jones | 59/90 UX |
| 332,053 | 12/1885 | Cole | 59/93 X |
| 375,045 | 4/1887 | Breul . | |
| 382,953 | 5/1888 | Daniels | 59/90 UX |
| 603,247 | 5/1898 | Becker | 24/237 UX |
| 889,230 | 6/1908 | Hoffman | 24/230 R |
| 1,264,379 | 4/1917 | Doering | 24/237 |
| 1,296,718 | 12/1917 | Vaughan . | |
| 2,858,593 | 11/1958 | Trizarry | 24/230 R |
| 4,000,627 | 11/1974 | Wahlbeck . | |
| 4,170,809 | 1/1978 | Geldwerth et al. . | |

FOREIGN PATENT DOCUMENTS

| | | | |
|---|---|---|---|
| 844266 | 6/1970 | Canada | 24/230 R |
| 2407579 | 8/1975 | Fed. Rep. of Germany | 24/230 R |
| 14876 | 9/1897 | Switzerland | 24/230 R |
| 359172 | 10/1931 | United Kingdom | 59/93 |

*Primary Examiner*—F. Barry Shay

*Attorney, Agent, or Firm*—Sandler & Greenblum

[57] ABSTRACT

A jewelry clasp for a jewelry band having chain-link terminals comprises releasably interlockable male and female clasp members. Slip-on connection means are rigidly secured to the distal ends of the male and female members to provide a solderless arrangement for attaching the chain-link terminals of the clasp. Each slip-on connection means is formed from a helix having approximately 1½ coiled turns so as to form an entrance opening into which the chain-link terminal can be inserted into linking engagement and secured without soldering or special tools. A rectangular blank for making the male clasp member includes an end notch for receiving the helix to be rigidly secured and a laterally projecting leg adjacent thereto adapted to become bulbous when heated and thus form the pin portion of a safety latch.

17 Claims, 6 Drawing Figures

FIG. 4
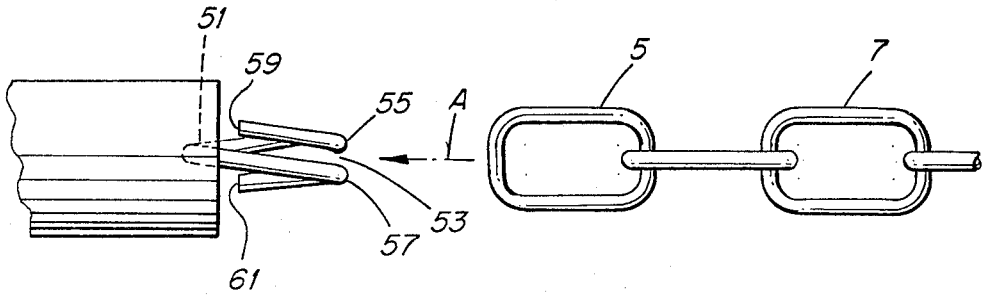
FIG. 5
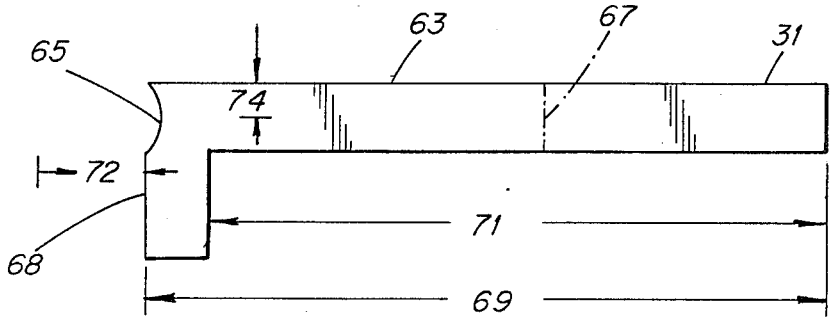
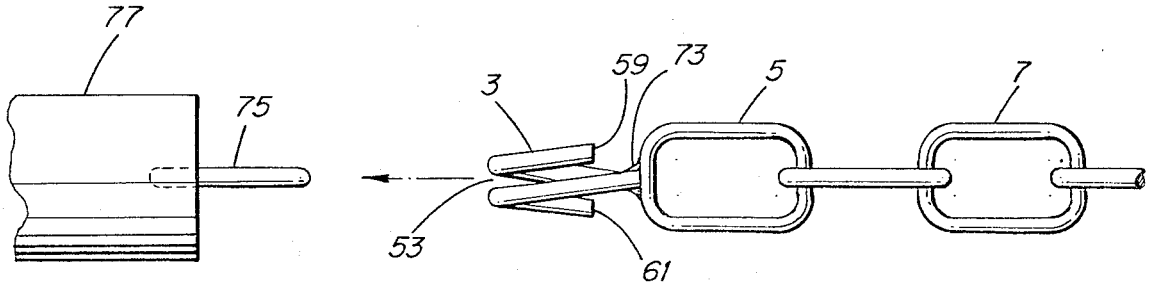
FIG. 6

SLIP-ON CONNECTOR FOR JEWELRY CLASP AND BLANK FOR CLASP

BACKGROUND OF THE INVENTION

1. Field of Invention

The present invention generally relates to jewelry clasps for chains, neck chains, bracelets and the like, and more particularly to a jewelry clasp having solderless slip-on connection means for attachment of the clasp to the outermost links of a chain.

2. Discussion of Prior Art

The inventive connection means may preferably be used with jewelry clasps of the type which include a hollow female clasp member adapted to be penetrated, through a slotted wall, by a male clasp member provided with a detent which is collapsible to permit passage through the slotted wall. Once inside a female clasp member, the male member re-expands so as to engage the slotted wall on its interior and thereby prevent disassembly of the members. Such a jewelry clasp is disclosed by U.S. Pat. No. 4,170,809 which is assigned to the Assignee of the present application, the disclosure of which is herein incorporated by reference. This patent also discloses means for re-collapsing the detent by external manipulation so as to permit separation of the male and female clasp members when desired.

Jewelry clasps employing releasably locking male and female clasp members are operationally quite efficient, but do suffer from certain disadvantages. Typically, a connection ring, formed at the distal ends of the male and female clasp members, is soldered to the outermost link of a chain intended to be looped and fastened around the wrist or neck of a wearer. When soldering this connection ring onto the terminal link of the jewerly chain, solder generally flows out over several links at the end of the chain causing these links to be soldered together into a stiff unit. This phenomenon is particularly apt to occur with thin chains where capillary forces tend to cause more than one link to be soldered.

There are further difficulties in providing local soldering to chains of small dimensions. For example, if a connection ring must be soldered to the end of a chain which has been ground and polished, at least the end portion of the chain will be heated which tarnishes the surface of the chain. These disadvantages are compounded if the chain has to be shortened since this is only possible by cutting the chain and then once again soldering the jumpring or, where possible, the outermost link of the chain on a new connection ring.

Aesthetic features constitute major considerations in jewelry. The above-noted problems, associated with the soldering of the terminal link of a jewelry band to a connection ring, oftentimes detracts from the appearance of a jewelry piece.

The prior art illustrates attempts at overcoming the above drawbacks such as WAHLBECK, U.S. Pat. No. 4,000,627, which discloses a pendant jewel chain in which it is possible to avoid a soldering of the end links of the chain to a spring ring or similar clasp means. Connection means are included which are formed from a relatively large control mark loop and a connection ring connected with the control mark loop. The outermost loop of the chain is hooked onto the connection ring which may be easily opened and closed. Although the arrangement eliminates many of the above-noted problems, the connection ring must be opened so that the outermost link of the chain may be hooked on whereupon the connection ring is closed to complete the attachment. Because the opening of the connection ring for the hooking on of the chain is affected by bending the branches of the connection ring to opposite sides in a plane at right angles to the body of the connection means, the connection ring undergoes metal fatigue and should this process be repeated several times, the connection ring is subject to weakening which affects the integrity of the connection arrangement. Additionally, the connection means disclosed by the WAHLBECK patent are not fixedly attached to the spring ring; but rather, are free to move with respect thereto. Thus, during the connection of the terminal links of a jewelry band or chain, difficulty is encountered in attempting to manipulate the various moving parts, particularly due to the diminutive sizes of the terminal chain links and connection means.

SUMMARY OF THE INVENTION

It is, therefore, an object of the invention to provide a means for securing a jewelry clasp to a chain which overcomes the above disadvantages and particularly to a connection means allowing for the attachment of a jewelry clasp to the terminal links of a chain without the need for the use of special tools or solder.

It is a further object of the invention to provide a jewelry clasp including connection means which can be stocked separately by stores and simply attached by salespersons onto chains once they have been cut to the desired lengths and also by repair shops who can stock the clasps.

According to one preferred embodiment of the invention, a jewelry clasp for attachment to a jewelry band having chain-link terminals is provided. In this embodiment the jewelry clasp includes a male clasp member and a female clasp member adapted to be releasably interlocked with the male clasp member. At least one slip-on connection means for attachment to at least one of the chain-link terminals of the jewelry band is rigidly secured to and provided for attachment to at least one of the male and female clasp members. The chain-link terminal is secured to the slip-on connection means by inserting the terminal into linking engagement therewith and is secured thereto without the need for soldering or special tools.

More particularly, according to the invention releasable interlocking male and female clasp members for a jewelry band having chain-link terminals are provided. The male clasp member includes a first slip-on connection means for attachment to one of the chain-link terminals. A detent projects from one side of the connection means, a tongue being formed as part of the detent. A leaf, with a free end constituted by a distal extension thereof, is folded to overlie the tongue in a normal angular position relative thereto, but is resiliently deflectable so as to lie flat against the tongue. The female clasp member includes a peripheral wall defining a slender tubular body within which the detent is receivable, one end of the body being open. A second slip-on connection means is rigidly secured to the open end of the body, and a wall partially closes the other end of the body. This wall has a narrow, elongated slot which extends substantially from one peripheral wall to the opposite peripheral wall of the body. The detent is insertable into the body of the female clasp member when the leaf is deflected so as to lie flat against the tongue. The leaf is biased to recover its normal angular position within the body to assure a releasably interlocking connection. External manipulable means are provided for deflecting the leaf in the interior of the body to flatten it against the tongue, thus enabling withdrawal of the detent from the body through the slot.

According to the invention, the slip-on connection means comprises a helix or helical spring adapted to be rigidly connected to the jewelry clasp so that the terminal links of the jewelry band are inserted between the coils of the spring and into linking engagement therewith without the need for soldering or special tools. Although the connection means is preferably affixed to the distal ends of the clasp portions, according to a less preferred embodiment the connection means can be affixed to the terminal links of the jewelry chain. The helix, which comprises the slip-on connection means, is formed from gold or alloys thereof or any other suitable material including those materials which can be gold plated.

According to the present invention there is also provided a blank for forming the male clasp member of the invention. The blank can be formed from gold, alloys thereof or any other suitable material and includes a notch for locating the slip-on connection means which may be attached by soldering or the like.

BRIEF DESCRIPTION OF THE DRAWINGS

The invention will now be described in greater detail with reference to the preferred embodiment thereof, as illustrated in the accompanying drawings, wherein like reference characters refer to the same parts throughout different views. The drawings are not necessarily to scale, emphasis instead being placed upon illustrating the principles of the invention.

FIG. 4 illustrates a schematic side view of how the chain-link terminals are slipped on for mounting to the clasp;

FIG. 5 is a top planar view illustrating the blank for forming the male clasp member of the present invention; and FIG. 6 illustrates an alternative embodiment in accordance with the present invention.

DETAILED DESCRIPTION OF THE PREFERRED EMBODIMENTS

Figure 1:
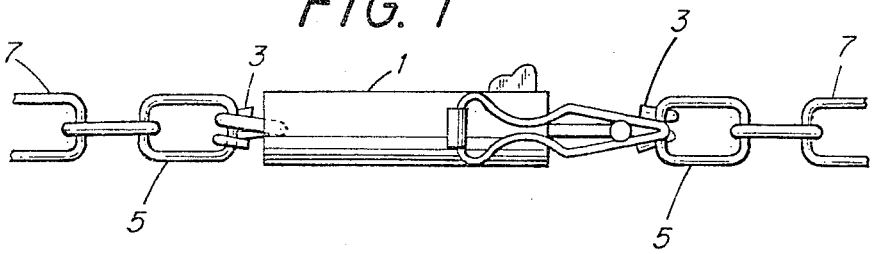
FIG. 1 is a planar side view of a jewelry band having chain-link terminals attached to a clasp in accordance with this invention.

FIG. 1 illustrates a jewelry clasp 1, having slip-on connection means 3 rigidly secured onto each end thereof. Attached to slip-on connection means 3 are chain-link terminals 5 of jewelry band 7.

Jewelry clasp 1 comprises a male clasp member, generally indicated at 9, and a female clasp member generally indicated at 11. Each male and female clasp member 9 and 11, respectively, has slip-on connection means 3 welded thereto, for receiving chain-link terminals 5 of jewelry band 7. Once terminal 5 is engaged with slip-on connection means 3, it cannot be unintentionally disengaged.

It is understood by one of ordinary skill in the art that slip-on connection means 3, according to the present invention, can be provided for only one or both of male or female clasp members 9 and 11. Alternatively, more than one slip-on connection means 3 can be provided for both or only one of male or female clasp members 9 and 11. Connection means 3 can be formed from gold, alloys thereof or any other suitable material including those materials which can be gold plated. Resilient and/or crimpable materials can also be utilized to form slip-on connection means 3.

Figure 2:
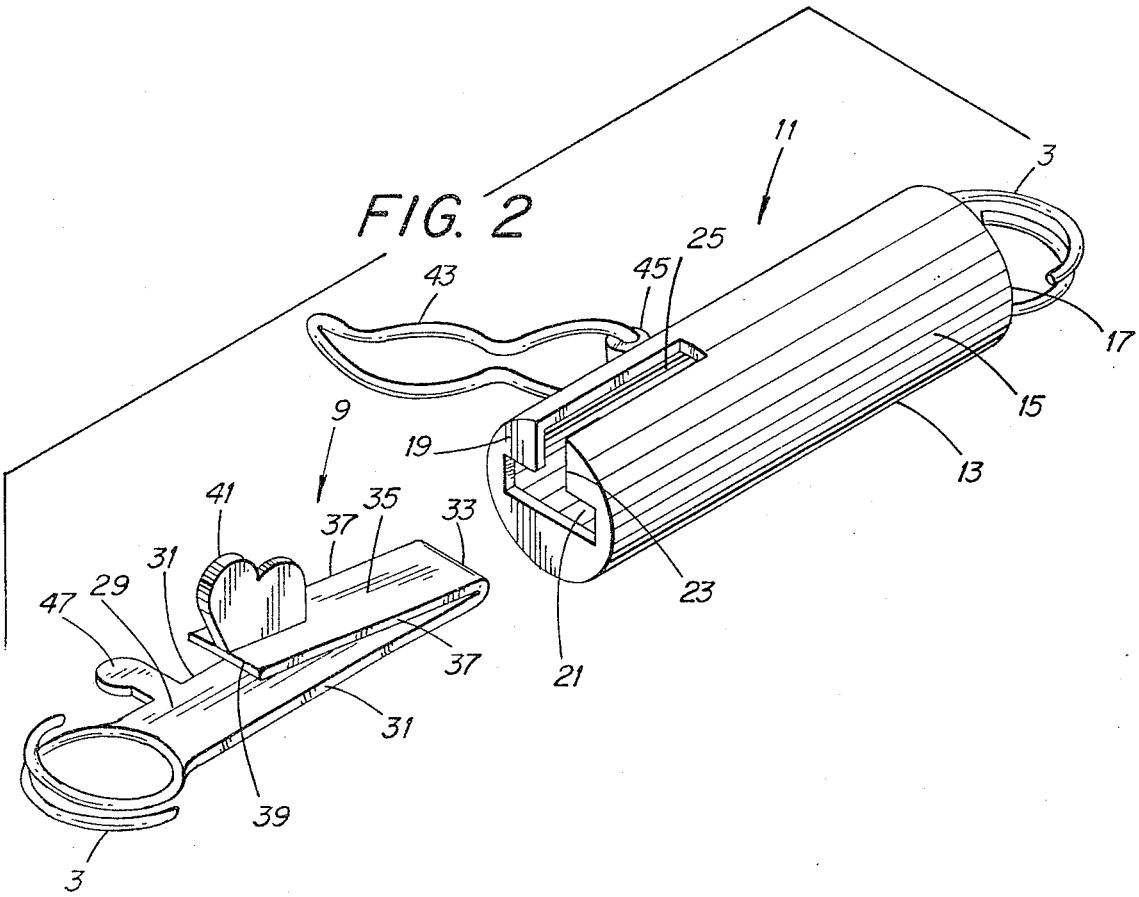
FIG. 2 is an exploded perspective view of the clasp illustrated by FIG. 1.

As illustrated by FIG. 2, female clasp member 11 has peripheral walls 13 which define a slender tubular body 15. Although a cylindrical tubular configuration is illustrated, other tubular configurations, e.g., square, rectangular, etc. may be used. One end 17 of body 15 is open, the other end of body 15 being closed by wall 19. Diametrically extending slot 21 is provided in wall 19 such that slot 21 extends essentially the full width of body 15. Second opening or slot 23 is formed in wall 19 so that slot 23 extends radially and perpendicularly relative to slot 21 into alignment with axially extending slot 25 in peripheral wall 13.

Male clasp 9 is equipped with pin 47 and comprises a detent which extends forwardly from slip-on connection means 3 and includes a generally rectangular tongue 29 which is rigidly secured to slip-on connection means 3. Rectangular tongue 29 is defined by spaced apart side edges 31—31 and by edge 33. Leaf spring 35 constituted by an integral distal extension of tongue 29 is folded back from end 33 to resiliently overlie tongue 29 and is itself defined by spaced apart edges 37—37 and free end 39.

It will be noted that, in the embodiment illustrated, tongue 29 is essentially identical in width to slot 21. In its relaxed position, leaf 35 extends angularly away from tongue 29, but is formed from a resilient, spring-like material so that it can be deflected to lie flat against the tongue as explained hereinafter.

Male clasp member 9 also includes external manipulable leaf-deflecting means in the form of upstanding fin 41 for resiliently deflecting leaf 35 towards tongue 29 in a manner which will be more readily understood as the description proceeds hereinafter.

Clasp 1 may also include a secondary safety catch comprising snap 43 pivoted at 45 on peripheral wall 13 of female clasp member 11 and a cooperating pin 47 on side edge 31 of male clasp member 9.

Figure 3:
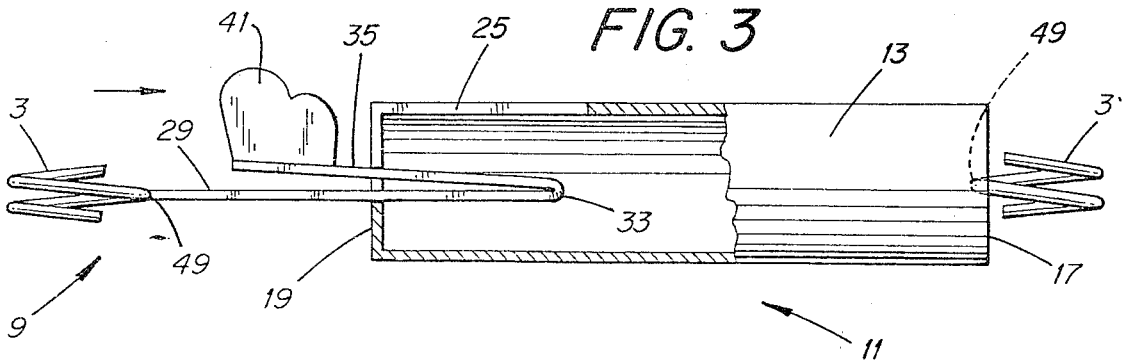
FIG. 3 is an axial sectional view through the clasp shown in the preceeding figures illustrating the male clasp member partially inserted into the female clasp member.

To secure clasp members 9 and 11 together, edge 33 of tongue 29 is first thrust through diametrically extending slot 21 in wall 19 of female clasp member 11. As a result, leaf spring 35 will be cammed to deflect automatically as shown in FIG. 3, upstanding pin 41 passing through radially extending slot 23 and into the axially extending slot 25. Once leaf spring 35 has passed wall 19, free end 39 of leaf spring 35 assumes the relaxed and re-expanded position, illustrated in FIG. 2.

It will now be understood that male clasp member 9 cannot be disengaged from female clasp member 11 unless outwardly projecting fin 41 is depressed to deflect spring 35 back to its collapsed position flat against tongue 29. With male and female clasp members 9 and 11 respectively interlocked in the aforesaid manner, safety snap 43 can be releasably snapped over pin 47.

As best illustrated by FIG. 3, each slip-on connection means 3 is rigidly secured to each distal end of jewelry clasp 1 such as by means of soldering points 49. Soldering points 49 are hard soldered to prevent disengagement while handling.

Each connection means 3 comprises a helix or helical spring of approximately 1½ coils so as to form closed side 51, as illustrated in FIG. 4, which is attached along an intermediate portion of the helical spring to the distal end of clasp 1 so that open side or entrance 53 is accessible to chain-link terminals 5. The helix is partially recessed within body 15 such that the helix rests along the upper edge of wall 13 along two contact points at which the helix is soldered to the wall (see solder points of FIG. 2). To insert chain-link terminal 5 into engagement with slip-on connection means 3, chain-link terminal 5 is placed edgewise diagonally between coils 55 and 57 and is inserted into open side 53 in the direction of arrow A as illustrated in FIG. 4. Once chain-link terminal 5 abuts the interior of closed side 51, chain-link terminal 5 is looped around ends 59 and 61 of slip-on connection means 3. Thus, the engagement portion of chain-link terminal 5 is inserted into the intermediate plane between the two ends of the helical spring of slip-on connection means 3 and snagged into linking engagement therewith without having to close the ends of the helical spring, to provide a connection arrangement which eliminates the need for soldering or special tools.

Once chain-link terminal 5 has been slipped on to connection means 3, connection means 3 may further be crimped to prevent unintentional disengagement although crimping is not absolutely necessary.

Since chain-link terminal 5 is secured to jewelry clasp 1 without soldering and associated heating, oxidation and tarnishing of the chain which otherwise might occur are avoided. Further, as noted above chain 7 may, by simple means and without using any special tools, be slipped on to connection means 3 and may be shortened if necessary. A further advantage is derived by the rigid connection of slip-on connection means 3 to clasp 1. When attaching or disengaging chain-link terminal 5 from clasp 1, the slip-on connection means is rigid with the corresponding portion of the clasp, thus allowing for easy insertion and removal by grasping of the clasp 1 without the necessity of separately positioning slip-on connection means 3 with regard to chain-link terminals 5.

Referring to FIG. 5, a blank form, generally indicated at 63, is illustrated for forming male clasp member 9 of jewelry clasp 1. Blank 63 is provided with a notch 65 for locating connection means 3. Edge 33 of male clasp member 9 is formed by bending blank 63 along line 67. Leg 68 when heated becomes bulbous and forms pin 47 for latching member 43. Blank 63 can be formed from gold, alloys thereof or any other suitable material including materials which can be gold plated.

EXAMPLE

For a clasp having an outer diameter of approximately 2 mm. or 0.085 inches, notch 65 has a radius of curvature of approximately 0.050 inches. Overall length 69 of blank 63 is approximately 0.565 inches with inner dimension 71 being on the order of 0.515 inches. Leg 68 has a width of approximately 0.050 inches before heating. Dimension 72, which is only on the order of 0.025 inches, positions the center of curvature of notch 65 relative to the distal end of the blank 63. Dimension 74, which positions the center of curvature of notch 65 relative to edge 31, is on the order of approximately 0.015 inches.

FIG. 6 illustrates an alternative embodiment of the present invention wherein slip-on connection means 3 is soldered at 73 to chain-link terminal 5 of jewelry band 7. This arrangement makes it possible to attach chain-link terminal 5 to a conventional connection ring 75 of a jewelry clasp 77 without the need for soldering. As explained, in FIG. 4, the conventional connection ring 75 is inserted into open side or entrance 53 of slip-on connection means 3 and moved around ends 59 and 60 into linking engagement with slip-on connection means 3.

While the invention has been particularly shown and described with reference to preferred embodiments thereof, it will be understood by those skilled in the art that various changes in form and detail may be made therein without departing from the spirit and scope of the invention as defined by the appended claims.

What is claimed is:

1. A jewelry clasp for a jewelry band having chain link terminals, said jewelry clasp comprising:

(a) a male clasp member;

(b) a female clasp member adapted to be releasably interconnected with said male clasp member; and (c) at least one slip-on connection means for attachment to at least one of said chain link terminals of the jewelry band, said slip-on connection means having two spaced portions and being rigidly secured to and being provided for at least one of said male and female clasp members;

whereby at least one of said chain link terminals may be inserted into at least one of said connection means so as to be directly inserted into linking engagement therewith by insertion through the space between said spaced portions and secured thereto without soldering, and whereby said one of said chain link terminals can be securely snagged onto said slip-on connection means without closing said spaced portions of said slip-on connection means.

2. A jewelry clasp according to claim 1, wherein said male clasp member comprises:

(a) a detent;

(b) a tongue forming part of said detent;

(c) a leaf with a free end constituted by a distal extension thereof folded to overlie said tongue in a normal angular posture relative thereto but being resiliently deflectable to lie flat against said tongue; and wherein said female member comprises;

(a) peripheral walls defining a slender tubular body in which said detent is receivable, one end of said body being open;

(b) a wall partially closing the other end of said body, said wall having a narrow, elongated slot extending substantially from one peripheral wall to the opposite peripheral wall;

(c) said detect being insertable into said body of said female clasp member when said leaf is deflected to lie flat against said tongue, said leaf being biased to recover its normal angular posture within said body; and (d) externally manipulable means for deflecting said leaf in the interior of said body to flatten it against said tongue enabling the withdrawl of the detent from said body through said slot.

3. A jewelry clasp according to claim 1, further including a secondary safety catch comprising:

(a) a snap adapted to be pivoted on the outer peripheral wall of said female clasp member; and (b) a cooperating pin extending transversely to the longitudinal axis of said male clasp member.

4. A jewelry clasp according to claim 1, wherein said slip-on connection means comprises a helix having an entrance adapted to receive at least one of said chain-link terminals of a jewelry band.

5. A jewelry clasp according to claim 4, wherein said connection means comprises a helix having 1½ coil turns so as to form an entrance opening for accepting the chain-link terminal of a jewelry band.

6. A jewelry clasp according to claim 1, wherein said at least one slip-on connection means is formed from gold, alloys thereof or gold-plated materials.

7. The jewelry clasp according to claim 1 wherein said slip-on connection means is rigidly secured to a distal end of said at least one male and female clasp members.

8. The jewelry clasp according to claim 7 wherein said connection means comprises a helix having an entrance adapted to receive at least one of said chain-link terminals of said jewelry band.

9. The jewelry clasp according to claim 8 wherein said clasp member, having said slip-on connection means secured thereto, comprises a tubular body.

10. The jewelry clasp according to claim 8 wherein said clasp member, having said slip-on connection means secured thereto, comprises a flat, rectangular tongue member.

11. In combination with a jewelry bracelet having chain-link terminals, a jewelry clasp comprising:

(a) a male clasp member;

(b) a female clasp member adapted to be releasably interconnected with said male clasp member; and (c) slip-on connection means for attachment to said chain-link terminals of said jewelry band, said slip-on connection means having two spaced portions and being rigidly secured to and provided for, at least one of said male and female clasp members;

whereby at least one of said chain-link terminals is inserted into one of said connection means so as to be slipped into linking engagement therewith by insertion through the space between said spaced portions and secured thereto without soldering and whereby said one of said chain link terminals can be securely snagged onto said slip-on connection means without closing said spaced portions of said slip-on connection means.

12. A blank for forming the male clasp member of a jewelry clasp comprising releasable interlocking male and female clasp members, said blank comprising:

(a) a substantially rectangular elongated flat body having a notch formed at one end thereof; and (b) a leg extending transversely to said elongated body, said leg being adapted to become bulbous when heated so as to form a pin.

13. A blank according to claim 10, further comprising at least one slip-on connection means attached to at least one of the chain-link terminals of a jewelry band, said slip-on connection means being adapted to receive at least one of said connection means being adapted to receive at least one of said chain-link terminals so as to be slipped into engagement therewith and secured thereto without soldering.

14. A blank according to claim 11, wherein said notch is adapted to position said slip-on connection means.

15. A blank according to claim 12, wherein said blank is formed from gold, alloys thereof or gold-plated materials.

16. A blank according to claim 12 wherein said leg is integral with said body, co-planar with and extending transversely to said body.

17. A jewelry clasp for a jewelry band having chain link terminals, said jewelry clasp comprising:

(a) a male clasp member;

(b) a female clasp member adapted to be releasably interconnected with said male clasp member; and (c) at least one slip-on connection means for attachment to at least one of said chain link terminals of said jewelry band, said slip-on connection means being rigidly secured to and being provided for at least one of said male and female clasp members, said slip-on connection means further comprising a helix having two exposed ends along the helix ring, said two ends being out of contact with one another;

whereby at least one of said chain link terminals may be inserted into at least one of said connection means so as to be slipped into linking engagement there with without soldering and without altering said out of-contact condition of said ends.

* * * * *